United States Patent [19]

Hasegawa et al.

[11] 4,245,794

[45] Jan. 20, 1981

[54] YARN WINDING APPARATUS

[75] Inventors: Katsumi Hasegawa, Kusatsu; Michio Ohno, Ibaraki, both of Japan

[73] Assignee: Toray Industries, Inc., Tokyo, Japan

[21] Appl. No.: 9,958

[22] Filed: Feb. 6, 1979

[30] Foreign Application Priority Data

Feb. 16, 1978 [JP] Japan ..... 53-16701

[51] Int. Cl.[3] ..... B65H 59/38

[52] U.S. Cl. ..... 242/45; 242/18 A; 242/35.5 R

[58] Field of Search ..... 242/45, 18 A, 18 DD, 242/36, 35.5 R

[56] References Cited

U.S. PATENT DOCUMENTS 3,913,852 10/1975 Lenk et al. ..... 242/18 A 3,931,938 1/1976 Hasegawa et al. ..... 242/45

FOREIGN PATENT DOCUMENTS 89646 7/1975 Japan .

*Primary Examiner*—Stanley N. Gilreath

*Attorney, Agent, or Firm*—Miller & Prestia

[57] ABSTRACT

Yarn winding apparatus comprises means for supplying yarn at a constant speed, a winder having a yarn traverser and a fixed guide acting as a pivot for the traverse motion of the yarn.

The apparatus includes a force transducer for generating an electrical signal indicating yarn tension, a rotary pulsing guide for periodically deflecting the yarn to bring it into contact with the force transducer, a setting device for generating an electrical signal indicating a predetermined desired value of yarn tension, a comparator for producing an error signal indicating the difference between the force transducer electrical signal and the setting device electrical signal, and a regulator for regulating the speed of rotation of the winding spindle in response to the difference between the foregoing signals.

14 Claims, 11 Drawing Figures

FIG. 3.
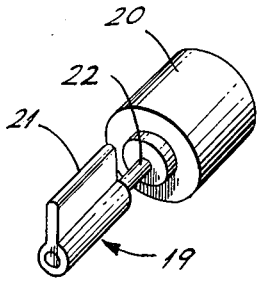
FIG. 4.
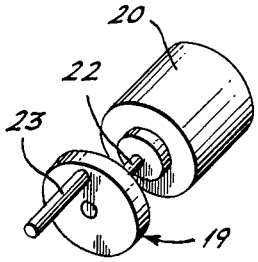
FIG. 5.
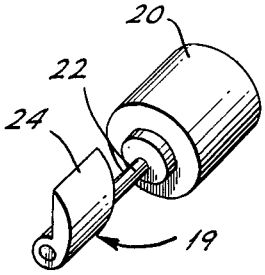
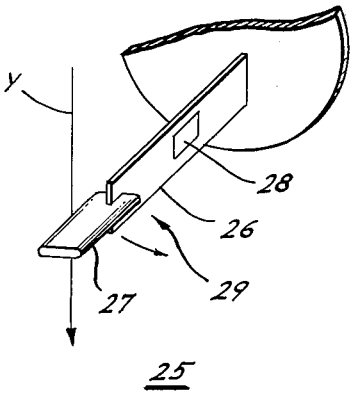
FIG. 6.
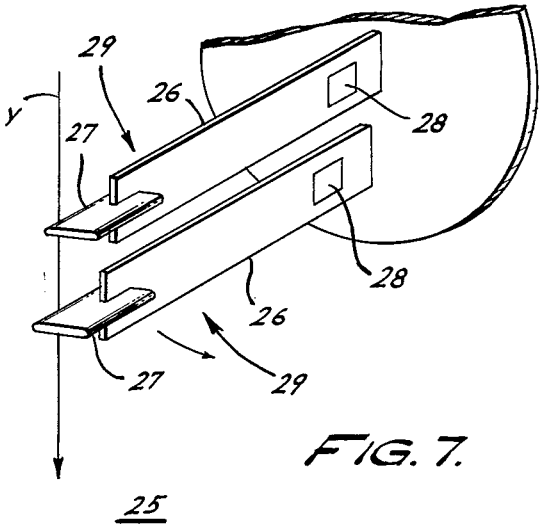
FIG. 7.

FIG. 8.
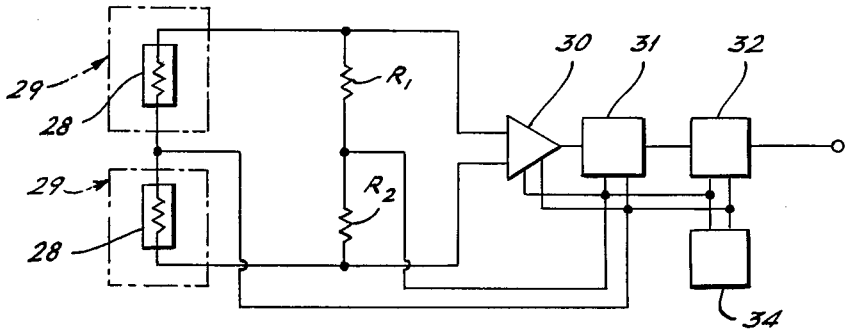
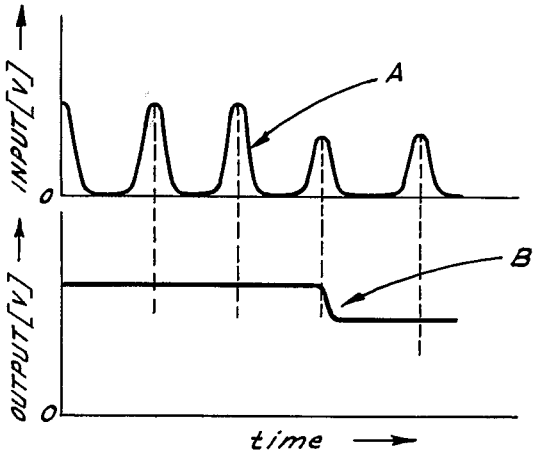
FIG. 9.

YARN WINDING APPARATUS

BACKGROUND OF THE INVENTION

The present invention relates to a yarn tension control and to winding apparatus used in the textile industry and, more particularly to a control device for winding a yarn package under a predetermined substantially constant tension.

A yarn winding apparatus for winding a yarn continuously supplied at substantially constant speed, into a yarn package under a predetermined substantially constant tension, is disclosed in, for instance, U.S. Pat. No. 3,931,938. In this yarn winding apparatus a force transducer is provided which is periodically vibrated by a vibrator at right angles to the yarn. Tension signals may be obtained by periodically bringing the force transducer into contact with the running yarn. The force transducer has a strain gauge and the strain produced is taken out as the tension signal.

However, because of the use of a vibrator, the strain produced by this vibration on the strain gauge becomes overlapped, as a noise, on the tension signal. This makes it difficult to detect tension with a high degree of accuracy. Particularly at low yarn tension, a special signal treatment has been necessary to eliminate the noise from the tension signal, since the magnitude of tension signal obtained itself is small. Also, the lead wire of the strain gauge is liable to vibration damage, shortening the life of the force transducer.

On the other hand, Japanese Pat. Laid open No. 89646/75 discloses a yarn winding apparatus in which a plurality of supply yarns are wound into yarn packages at about the same time and under the same winding conditions. In this yarn winding apparatus, a dancer arm type tension detector is provided for at least one of the yarns and the speed of rotation of all the winding devices is simultaneously regulated on the basis of the tension signal obtained from the one tension detector.

In this yarn winding apparatus, however, the dancer arm is employed as the tension detector and the yarn path is bent to a large measure by this dancer arm; hence, the tension loss at the tension detector is extremely large. Further, since the tension loss is large, it is difficult to carry out the winding operation under low tension. Further, in order to wind each yarn into a yarn package the tension loss should be more or less the same with all yarns. For this reason, dummy dancer arms are needed for yarns having no tension detectors and the paths of such yarns are bent in the same manner, with resultant tension loss. This arrangement also involves cumbersome operations such as passing all yarns through guides, which is an operating inconvenience and increases cost. Furthermore, the yarn is likely to be damaged from being squeezed through the guide. Accordingly, the system is not suitable for winding at high speed.

An object of the present invention is to provide a spindle drive type yarn winding apparatus with which it is possible to maintain the tension of yarn at a predetermined substantially constant level with a high degree of accuracy during the winding operation.

Another object is to provide a spindle drive type yarn winding apparatus which permits high speed winding with a minimum of damage to the yarn.

Still another object is to provide a spindle drive type yarn winding apparatus with which it is possible to wind yarns into yarn packages with minimum yarn tension loss at the tension detector.

Still other objects of the present invention will become apparent from embodiments of the invention hereinafter explained, and from the drawings.

BRIEF DESCRIPTION OF THE DRAWINGS

FIGS. 3 to 5 are schematic perspective views showing various forms of rotary guides.

FIGS. 6 and 7 are schematic perspective views showing various force transducers useful in the present invention.

FIG. 8 is a schematic block diagram showing an example of the signal treatment circuit of the force transducer in the embodiment shown in FIG. 7.

FIG. 9 is a graph showing the wave form of the output signal of the signal treatment circuit shown in FIG. 8.

DETAILED DESCRIPTION OF PREFERRED EMBODIMENTS

Figure 1:
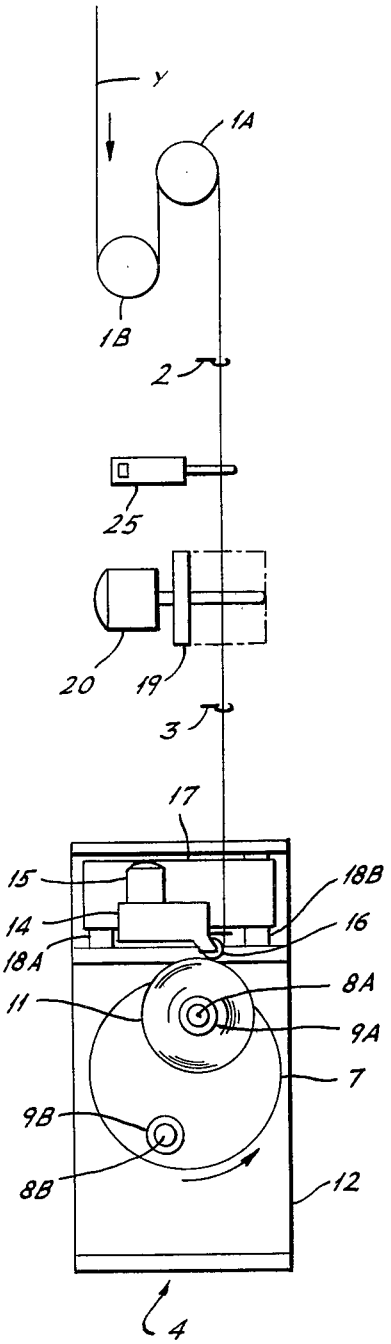
FIG. 1 is a schematic front view showing one particular embodiment of a yarn winding apparatus of the present invention.
Figure 2:
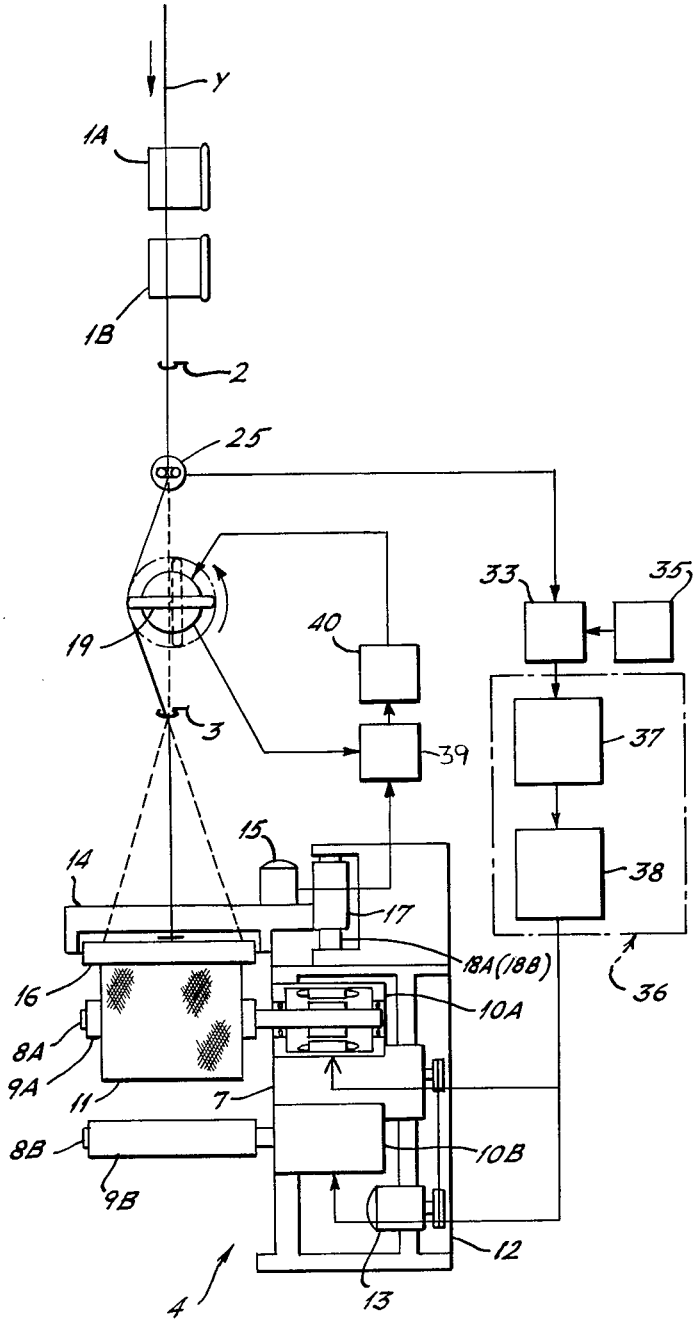
FIG. 2 is a schematic side view of the yarn winding apparatus shown in FIG. 1.

In FIGS. 1 and 2, the symbols 1A and 1B indicate feed rollers and a yarn Y is continuously supplied at a constant speed in the direction of the arrows by these feed rollers 1A and 1B. Said yarn Y is, for example, a yarn spun from a spinnerette. The numeral 2 indicates an anti-shaking guide for prevention of shaking of the yarn Y, and the numeral 3 indicates a fixed guide acting as the fulcrum or pivot point of the traverse motion of the yarn Y. The numeral 4 indicates a revolving type winder. Said winder 4 has a turret 7 rotatably provided on it, fitted with two winding spindles 8A and 8B in symmetrical positions, driven in the direction of the arrow by induction motors 10A and 10B (FIG. 2) respectively.

On the winding spindles 8A and 8B are mounted yarn winding bobbins 9A and 9B, respectively, for winding the yarn Y; and on one of the winding bobbins, 9A, a yarn package 11 is being formed in the form of a cheese. As soon as the formulation of said yarn package 11 is completed, the turret 7 is rotated about 180° in the direction of the arrow by a motor 13 fitted to a frame 12 of the winder 4, and then a yarn package is formed on the winding bobbin 9B in turn. While a yarn package is being formed on the winding bobbin 9B, the yarn package 11, which was previously formed, is removed from the winding spindle 8A and an empty winding bobbin is mounted on it.

In the winder 4, there is provided, upstream of the winding spindle 8A (8B), a traverser 14 which imparts a traverse motion to the yarn Y. Also, this yarn traverser 14 is provided with a touch roll 16, which, being in touch with the yarn package 11, rotates inversely to the rotation of the yarn package and applies a surface pressure of predetermined value to the yarn package 11. The yarn traverser 14 is slidably mounted, by a holder 17, on guide shafts 18A and 18B provided inside a frame 12 of the winder 4; and with formation of the yarn package 11, it gradually moves upwards toward the fixed guide 3.

Between the fixed anti-shaking guide 2 and the fixed guide 3 is a rotary pulsing guide 19 which is rotated in the direction of the arrow by an induction motor 20 and periodically deflects the yarn Y slightly from its straightline path extending between guides 2 and 3. The rotary pulsing guide 19 preferably turns in the same direction as that in which the yarn Y runs. A force transducer is provided in the path of the yarn Y, between guides 2 and 3, and in a position to sense changes of yarn tension due to the pulsing action of pulsing guide 19. When transducer 25 is contacted by the yarn Y, it generates an electrical signal which corresponds to the tension of the yarn Y then applied.

In operation, with reference to FIGS. 1 and 2, when the rotary pulsing guide 19 is rotated, the yarn Y is pulsated between the solid line and the dash line positions and a pressure is intermittently applied to the force transducer 25 by the yarn Y. The strain gauge thereon, details of which will appear in further detail hereinafter, detects the resulting force and signals it through a comparator 33 shown in FIG. 1.

The comparator 33 is connected to the rotary pulsing guide 19 and also to a setting device 35 which generates an electrical signal corresponding to the desired tension of the yarn Y. The comparator 33 compares the output signal of this setting device 35 with the tension signal sent from the rotary pulsing guide 19 and sends a signal indicative of the difference between the two signals to a regulator 36 (FIG. 1) The regulator 36 comprises a controller unit 37 and a power regulator unit 38, which modifies the amount of power supplied to the induction motor 10A (10B) which drives the winding spindle 8A (8B), thereby regulating the speed of rotation of the winding spindle 8A (8B).

The tension of yarn Y normally tends to increase but not to decrease during the yarn winding operation. If the tension of the yarn Y is higher than the desired value, the power regulator unit 38 reduces the power supplied to the induction motor 10A (10B) according to the magnitude of the signal difference in response to a command of the controller unit 37. Accordingly, the speed of rotation of the winding spindle 8A (8B) decreases and the tension of the yarn Y is maintained substantially constant.

It is also possible to provide upper and lower limit tension regulation in place of the upper limit regulation system as aforesaid. In this instance, a comparator is used which is capable of indicating whether the signalled value is positive or negative. The regulator then either increases or decreases the speed of rotation of the winding spindle on the basis of the two signals.

The tension of the yarn Y tends to be highest at the two extremities of the area covered by its traverse motion and lowest at the center. Accordingly, to improve accuracy it is desirable to detect yarn tension with the yarn Y always in the same traverse position. Although such position could be arbitrarily selected, the center is preferred because the tension of the yarn Y is the lowest and there is less chance of yarn damage by contact with the force transducer 25 and the rotary pulsing guide 19. Besides, the loss of tension is smaller.

Accordingly, referring to FIG. 2, a comparator 39 is provided for comparing the phase of the induction motor 15 which drives the yarn traverser 14 with that of the induction motor 20 which drives the rotary pulsing guide 19; on the basis of the difference between the two phases, the phase of the induction motor 20 which drives the rotary pulsing guide 19 is regulated; and the tension of the yarn is detected when the yarn Y and the rotary pulsing guide 19 are in the positions indicated by the solid line in FIG. 2. The regulation of the phase of the induction motor 20 is carried out by a regulator 40 (FIG. 2) which is connected to the comparator 39. The frequency at which the rotary pulsing guide 19 contacts yarn Y can be adjusted as desired by adjusting its rotation speed. For instance, rotation speed may be so controlled that rotary pulsing guide 19 contacts yarn Y in only the direction of travel of the yarn Y, or even only once while the yarn makes several strokes. Further, the tension signal may either be taken out every time the yarn Y contacts the rotary pulsing guide 19, or may be taken out as a mean value of tensions measured during several contacts.

FIGS. 3, 4 and 5 show different examples of the rotary pulsing guide. In FIG. 3, it is a blade 21 with a rounded edge. In FIG. 4, it is a guide pin 23 projecting from a circular plate fixed on shaft 22. In FIG. 5, it has the form of a cam having a curved yarn guide surface 24. A rotary guide of any desired shape or type may be used, so long as it is provided with a pulsing yarn guide surface. Besides, a plurality of such surfaces may be provided, in symmetrical positions.

Although the force transducer 25 can be constructed as in U.S. Pat. No. 3,931,938, other examples are shown in FIGS. 6 and 7. In FIG. 6, only one force transducer element is provided; while in FIG. 7, two are provided.

The force transducer 25 has a force transducer element 29, consisting of an elastic plate 26 with one end fixed, a guide 27 fixed to its other end and a strain gauge 28 adhered to elastic plate 26.

When the yarn Y runs in a predetermined path as illustrated in FIG. 7, guide 27 of transducer 25 is biased in the direction of the arrow and adds strain to the elastic plate 26. Such strain is converted, by a conventional strain gauge circuit and signal processor (not shown) into a signal indicative of the tension of the yarn Y. Usually ony one force transducer element will serve the purpose. When, however, vibrations and temperature flucturations are encountered, two force transducer elements are preferred. One force transducer element detects the tension of the yarn as well as the vibrations; while the other force transducer element, which is not brought into contact with the yarn, detects only the vibrations. The resultant signal is imposed upon a bridge circuit by strain gauges in the force transducers. By this means, the effect of temperature fluctuations and vibrations is eliminated and a pure electrical signal corresponding to the tension of yarn is obtained.

FIG. 8 shows an example in which a combination of two force transducer elements 29 is employed. A bridge is formed by circuits including resistances $R_1$ and $R_2$ in the signal treatment circuit. The resistances 28 vary with the tension of yarn. The bridge output is amplified by an amplifier 30 and is fed into a band elimination filter 31. The output of the band elimination filter 31 is fed into a peak detector circuit 32, and its output is fed into the comparator 33 shown in FIG. 1. The numeral 34 indicates the power supply.

FIG. 9 is a voltage-time diagram showing the relationship between the input and output signals of the peak detector circuit 32 as shown in FIG. 8. Curve "A" indicates the input signal of the peak detector circuit, and its peak values show the tension of the yarn measured intermittently in response to the pulsations of the rotary pulsing guide 19. The curve "B", on the other hand, shows the output signal of the peak detector circuit, retaining the peak values of the curve "A".

Figure 10:
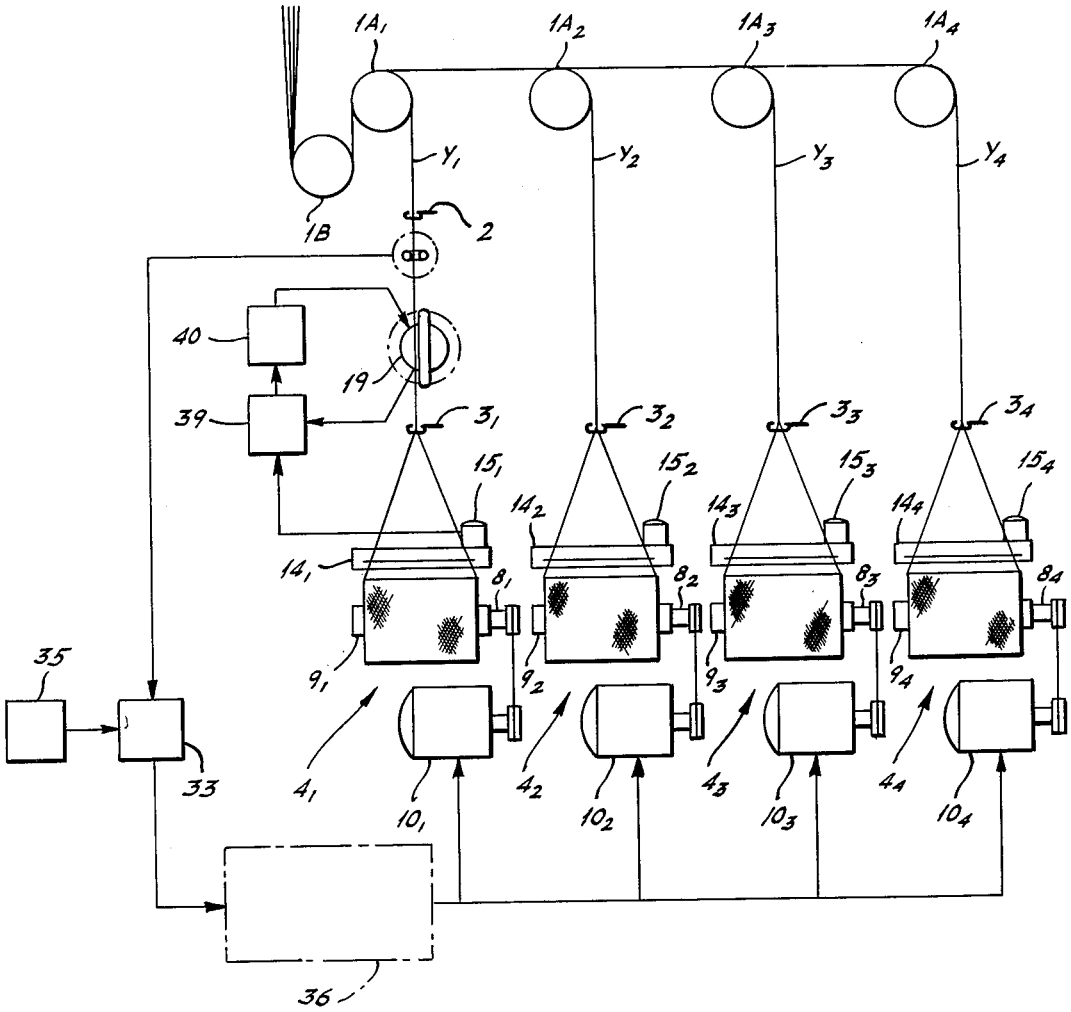
FIG. 10 is a schematic front view showing a yarn winding apparatus as another embodiment of the present invention.

FIG. 10 is a schematic front view showing a plurality of yarns with a plurality of winders; the tension is detected of only one of a plurality of yarns, and on the basis of this signal all the winders are simultaneously controlled.

In FIG. 10, the symbols $1A_1$ to $1A_4$ and 1B, indicate feed rollers which continuously supply yarns $Y_1$ to $Y_4$, respectively, at a constant speed. Winders $4_1$ to $4_4$ are similar to that shown in FIGS. 1 and 2 and respectively comprise winding spindles $8_1$ to $8_4$ for mounting winding bobbins $9_1$ to $9_4$, synchronous motors $10_1$ to $10_4$ which respectively drive winding spindles $8_1$ to $8_4$ yarn traversers $14_1$ to $14_4$ for yarns $Y_1$ to $Y_4$ respectively, and induction motors $15_1$ to $15_4$ driving the yarn traversers $14_1$ to $14_4$. The numeral 2 indicates an anti-shaking guide which is provided for only the yarn $Y_1$ the tension of which is to be detected. The numerals $3_1$ to $3_4$ indicate fixed guides acting as fulcrums of the traverse motions of the yarns.

In FIG. 10 only the tension of this yarn $Y_1$ is detected. This may be done as in FIGS. 1 and 2, for example. The signal indicative of yarn tension is compared with the desired value by the comparator 33. The output signal of the comparator 33 is likewise sent to the regulator 36, which in this instance regulates the speed of rotation of all the winding spindles $8_1$ to $8_4$, of the winders $4_1$ to $4_4$, under entirely the same conditions. That is to say, it is possible to control the tensions of all of the yarns with the tension of only one yarn beging detected. This is because the means of detection applies little loss of tension to the running yarn.

In the embodiment described above, it is also possible to drive a plurality of winding spindles simultaneously with a single synchronous motor. Further, the synchronous motors $10_1$ to $10_4$ for driving the winding spindles $8_1$ to $8_4$, respectively, may be substituted with induction motors having identical slip rates.

Alternatively, in FIG. 10, the rotary pulsing guide 19 may be provided for a plurality of yarns, for instance, both yarns $Y_1$ and $Y_2$. Even if the yarn $Y_1$ is broken and it becomes impossible to detect tension with it, it is still possible to continue the winding operation with the tension being detected with the yarn $Y_2$. Still further, it is also possible to provide, between a set of force transducers and the comparator, a means for equalizing tension signals, so that a mean value of the tension signals from all force transducers may be forwarded to the comparator as an input.

Although in the foregoing embodiment, the initial feed roller 1B is being used in common to the yarns $Y_1$ to $Y_4$, separate initial feed rollers may be provided for each of the yarns $Y_1$ to $Y_4$.

Figure 11:
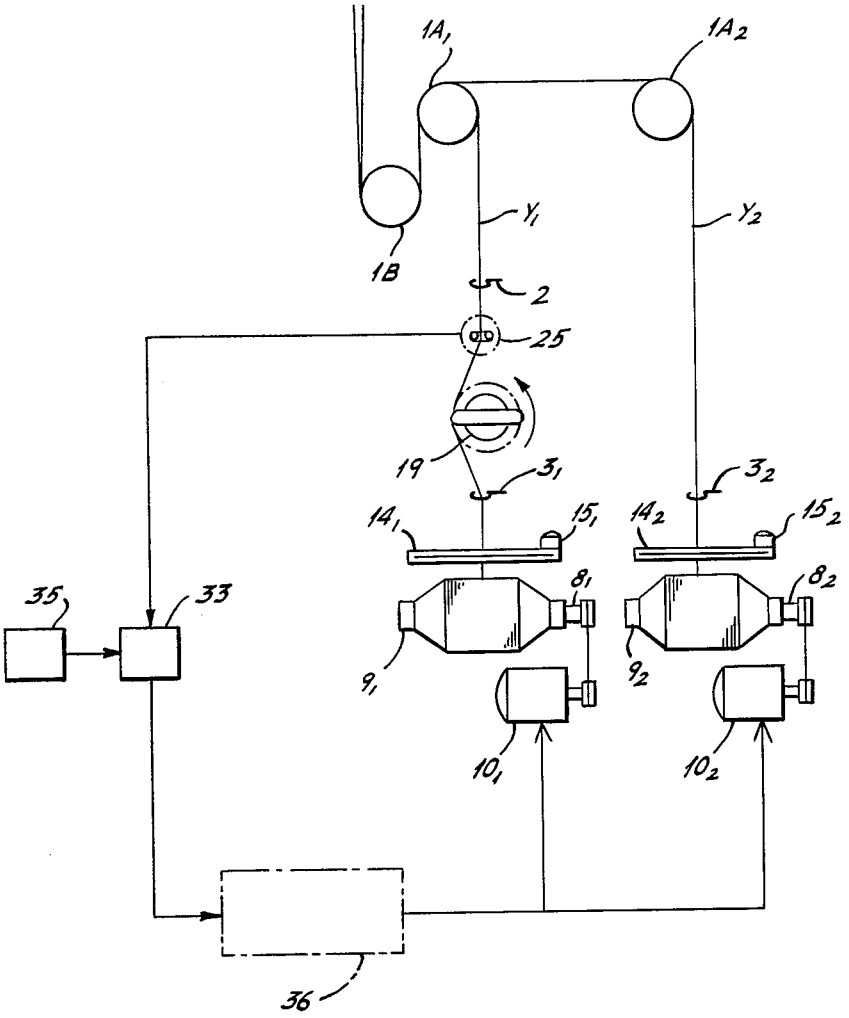
FIG. 11 is a schematic front view of a yarn winding apparatus as still another embodiment of the present invention.

The foregoing embodiments can be applied when winding on a pirn as well as a cheese. FIG. 11 is a schematic front view showing this, all common reference numbers having the same meaning. Where the yarn package is a pirn, the speed of traverse motion of the yarn is very low. Therefore, the difference between tension at the center of the traverse motion and that at the two extremities is small. Accordingly, it is not always necessary to control the traverse position of the rotary pulsing guide. In this instance, therefore, the comparator 39 and the regulator 40 are not always required.

The relative positions of the tension detector and the rotary pulsing guide along the yarn path may be reversed. Also, the spindle drive motor may have its own speed change function, such as an eddy-current coupling or a mechanical stepless speed change device, controlled conventionally from the regulator.

The yarn winding apparatus of the present invention provides a rotary pulsing guide whereby the running yarn is periodically shaken to a small measure so that it gets into contact with a force transducer, thereby to obtain tension signals which accurately maintain the winding tension during the yarn winding operation. In addition, the force transducer is not positively vibrated by a vibrator and the life of the force transducer is extended.

Further, the yarn is not bent to a large measure by a dancer arm and the loss of yarn tension is small. This makes winding under low tension possible, and makes it unnecessary to provide dummy tension detection means for the other yarns in FIGS. 10 and 11. Accordingly, string-up procedures of passing yarns through guides are minimized and the operational efficiency of the yarn winding apparatus is improved, thus reducing manufacturing cost. Besides, as there is little chance of the yarn being damaged from being squeezed through guides, it becomes possible to carry out a high speed winding operation.

Although this invention has been described with reference to specific embodiments thereof, it will be appreciated that equivalent elements may be substituted for various components of the apparatus, including the yarn supplies, the winders, the guides and the pulsing devices, that various comparators and force transducers may be used, and that parts and sequences may be reversed in many cases without adversely effecting the operation or advantages of the invention. Further, certain features of the invention may be used independently of other features, all without departing from the spirit and scope of the invention as defined in the appended claims.

We claim:

1. In a yarn winding apparatus wherein means are provided for supplying yarn at substantially constant speed, and wherein means are provided for winding the yarn into a yarn package and for imparting a traverse motion to the yarn back and forth along the yarn package, the combination which comprises:

(a) spaced-apart yarn guides disposed upstream of said means for the traverse motion for providing a straight yarn path for said yarn, (b) yarn tension sensing means fixed adjacent said path between said spaced-apart yarn guides and having capacity to sense yarn tension and generate a tension signal corresponding thereto, (c) yarn deflecting means adjacent said path between said spaced-apart yarn guides and spaced apart from said tension sensing means for deflecting said yarn from its straight-line path to make intermittent contact with said tension sensing means, (d) a setting device for generating a signal corresponding to the desired yarn tension, (e) means for comparing the aforesaid signals to generate an error signal indicative of the difference between the two signals, and (f) means for changing the winder speed in response to the error signal, and which include a further yarn winding apparatus, wherein the said regulator means is also connected to regulate the speed of said further winding apparatus.

2. A yarn winding apparatus comprising:

(a) a yarn supplier for supplying a yarn at a constant speed, (b) a winding device for winding the yarn into a yarn package, the winding device including more than one winding spindle for mounting a winding bobbin, the winding spindle being driven by a motor, and a yarn traverser for imparting a traverse motion to the yarn in the directions parallel to the longitudinal axis of the yarn package, the yarn traverser being disposed upstream of the winding spindle, (c) a fixed guide through which the yarn runs to the yarn traverser, said fixed guide being disposed upstream of the yarn traverser and acting as the fulcrum of the traverse motion of the yarn, (d) a force transducer for generating an electrical signal indicative of the tension of the yarn, the force transducer being disposed upstream of the fixed guide, (e) a rotary pulsing guide for periodically deflecting the yarn to bring it into contact with the force transducer, the rotary pulsing guide including a yarn guide surface fixed on a rotating shaft, and being disposed upstream of the fixed guide, (f) a setting device for generating an electrical signal indicative of a predetermined desired value of tension of the yarn, (g) a comparator for comparing the force transducer electrical signal with the setting device electrical signal, thereby to generate an error signal indicative of the different between the two signals, the comparator being connected to the force transducer and the setting device, and (h) a regulator for regulating the speed of rotation of the winding spindle in response to the error signal, the regulator being connected to the comparator and the motor.

3. A yarn winding apparatus comprising:

(a) a plurality of yarn supplies for supplying a plurality of yarns at a constant speed, (b) a plurality of winding devices for winding each of the yarns into a yarn package, each of the winding devices including more than one winding spindle for mounting a winding bobbin on each, the winding spindle being driven by a motor, and a yarn traverser for imparting a traverse motion to the yarn in the directions parallel to the longitudinal axis of the yarn package, the yarn traverser being disposed upstream of the winding spindle, (c) a plurality of fixed guides, one each for all the winding devices, acting as the fulcrum of the traverse motion of the yarn, the fixed guide being disposed upstream of the yarn traverser, (d) a force transducer for generating an electrical signal indicative of the tension of the yarn, (e) a rotary pulsing guide for periodically deflecting the yarn to bring it into contact with the force transducer, the rotary pulsing guide including a yarn guide surface fixed on a rotating shaft, both the force transducer and the rotary pulsing guide being disposed upstream of one of the fixed guides acting as the fulcrum of the traverse motion of the yarn, (f) a setting device for generating an electrical signal indicative of a predetermined desired value of tension of the yarn, (g) a comparator for comparing the force transducer electrical signal with the setting device electrical signal, thereby to generate an error signal indicative of the difference between the two signals, the comparator being connected to the force transducer and the setting device, and (h) a regulator for regulating the speed of rotation of the winding spindle in response to the error signal, the regulator being connected to the comparator and the motor and regulating the speed of rotation of the winding spindles of all the winding devices simultaneously.

4. A yarn winding apparatus as claimed in claim 2 or 3, further comprising:

(a) a phase comparator for comparing the phase of the rotary pulsing guide with that of the traversing yarn, thereby to generate an electrical signal indicative of the difference between the two phases, the phase comparator being connected to the motors for driving the rotary pulsing guide and for driving the yarn traverser, and (b) a regulator for regulating the phase of the rotary pulsing guide so that the yarn guide surface of the rotary pulsing guide may contact the running yarn when it is at the center of the area across which the yarn is traversed.

5. A yarn winding apparatus as claimed in claim 2 or 3, wherein the rotary pulsing guide rotates in such a manner that its yarn guide surface turns in the same direction as that in which the yarn runs where it contacts the yarn.

6. A yarn winding apparatus as claimed in claim 2 or 3, wherein the rotary pulsing guide consists of a plate member fixed to the rotating shaft and at least one guide pin fixed on the circular plate, projecting toward the yarn path from the plate.

7. A yarn winding apparatus as claimed in claim 2 or 3, wherein the rotary pulsing guide is a cam member having at least one curved yarn guide surface.

8. A yarn winding apparatus as claimed in claim 2 or 3, wherein the force transducer comprises a force transducer element having an elastic plate, a strain gauge attached thereto, and a guide fixed to an end of the elastic plate.

9. A yarn winding apparatus as claimed in claim 2 or 3, wherein a pair of force transducer elements are provided in a common circuit.

10. A yarn winding apparatus as claimed in claim 2 or 3, wherein the winding device is a revolving type winder having more than two winding spindles.

11. A yarn winding apparatus as claimed in claim 2 or 3, wherein the motor for driving the winding spindle is an induction motor.

12. A yarn winding apparatus as claimed in claim 2 or 3, wherein the motor for driving the winding spindle is a synchronous motor.

13. In an apparatus for controlling the tension of yarn wherein the yarn is continuously driven in a downstream direction, the combination which comprises:

(a) fixed spaced-apart yarn guides providing a straight yarn path for said running yarn, (b) tension sensing means adjacent said path between said spaced-apart yarn guides and having capacity to sense yarn tension and vibration, (c) yarn deflecting means adjacent said path between said spaced-apart yarn guides and spaced apart from said tension sensing means for deflecting said running yarn from its straight-line path to make contact with said tension sensing means, (d) standard signal generating means for generating a signal corresponding to the desired tension of said running yarn, (e) tension signal generating means connected to said tension sensing means (b), (f) differential signal generating means for obtaining the difference between said signals (d) and (e), and (g) means for controlling the yarn drive in response to the differential tension signal obtained from said means (f).

14. In an apparatus for controlling the tension of yarn wherein the yarn is continuously driven in a downstream direction, the combination which comprises:

(a) spaced-apart yarn guides providing a straight yarn path for said running yarn, (b) vibration sensing means adjacent said path for sensing vibration, (c) tension sensing means spaced from said means (b) and having capacity to sense yarn tension and vibration, (d) yarn deflecting means adjacent said path and spaced apart from said tension sensing means for deflecting said running yarn from its straight-line path to make contact with said tension sensing means, (e) vibration signal generating means connected to said vibration sensing means (b), (f) tension signal generating means connected to said tension sensing means (c), (g) means for subtracting the signal (e) from the signal (f) to provide a tension signal substantially free of the effect of vibration, and (h) means for controlling the yarn drive in response to the tension signal obtained from said means (g).

* * * * *